US008087876B2

(12) United States Patent
Inuzuka

(10) Patent No.: US 8,087,876 B2
(45) Date of Patent: Jan. 3, 2012

(54) FUEL PUMP

(75) Inventor: Yukio Inuzuka, Okazaki (JP)

(73) Assignee: Denso Corporation, Kariya (JP)

( * ) Notice: Subject to any disclaimer, the term of this patent is extended or adjusted under 35 U.S.C. 154(b) by 782 days.

(21) Appl. No.: 12/209,562

(22) Filed: Sep. 12, 2008

(65) Prior Publication Data

US 2009/0074559 A1 Mar. 19, 2009

(30) Foreign Application Priority Data

Sep. 14, 2007 (JP) ..... 2007-239961

(51) Int. Cl.
*F04D 1/04* (2006.01)

(52) U.S. Cl. ..... 415/55.1; 415/56.1; 415/57.1

(58) Field of Classification Search ..... 415/55.1, 415/56.1, 57.1
See application file for complete search history.

(56) References Cited

U.S. PATENT DOCUMENTS

| | | | | |
|---|---|---|---|---|
| 4,403,910 | A * | 9/1983 | Watanabe et al. | 415/55.4 |
| 4,538,968 | A * | 9/1985 | Kusakawa | 417/368 |
| 5,785,490 | A | 7/1998 | Dobler et al. | |
| 6,336,788 | B1 | 1/2002 | Fujii et al. | |
| 6,474,937 | B1 | 11/2002 | Rothkopf et al. | |
| 6,659,713 | B1 | 12/2003 | Fujii et al. | |
| 6,767,179 | B2 * | 7/2004 | Kusagaya et al. | 415/55.1 |
| 6,981,490 | B2 * | 1/2006 | Nagata et al. | 123/514 |
| 7,207,320 | B2 * | 4/2007 | Ikeya | 123/509 |
| 7,217,085 | B2 * | 5/2007 | Inuzuka | 415/55.1 |
| 7,500,820 | B2 * | 3/2009 | Inuzuka et al. | 415/55.1 |

FOREIGN PATENT DOCUMENTS

| | | |
|---|---|---|
| JP | H02-099794 | 4/1990 |
| JP | H06-042490 | 2/1994 |
| JP | H11-280686 | 10/1999 |
| JP | 2000-230492 A | 8/2000 |
| JP | 2006-291802 | 10/2006 |

OTHER PUBLICATIONS

Japanese Office Action dated Jul. 7, 2009, issued in corresponding Japanese Application No. 2007-239961, with English translation.

* cited by examiner

*Primary Examiner* — Jarrett Stark
*Assistant Examiner* — Nicholas Tobergte
(74) *Attorney, Agent, or Firm* — Nixon & Vanderhye PC

(57) ABSTRACT

A fuel pump includes an impeller and a casing member. The impeller defines a plurality of vane grooves arranged in a circumferential direction. The casing member receives the impeller, and the casing member defines therein a pump passage configured to have an arcuate shape along the vane grooves. The discharge passage is provided downstream of the pressurizing passage. The discharge passage has a width narrower than a width of the pressurizing passage, and the discharge passage is positioned toward a radially outer wall of the pressurizing passage. The pressurizing passage includes a throttle part that extends from a starting point to an inlet of the discharge passage. The throttle part has a first width at the starting point, which corresponds to the width of the pressurizing passage, and a second width at the inlet, which corresponds to the width of the discharge passage.

7 Claims, 4 Drawing Sheets

FUEL PUMP

CROSS REFERENCE TO RELATED APPLICATION

This application is based on and incorporates herein by reference Japanese Patent Application No. 2007-239961 filed on Sep. 14, 2007.

BACKGROUND OF THE INVENTION

1. Field of the Invention

The present invention relates to a fuel pump.

2. Description of the Related Art

A known fuel pump includes a casing and an impeller substantially in the form of a disk. The impeller has a circumferential array of vane grooves. The casing houses the impeller and has a pump passage, which is formed along the circumferential array, and through which fuel flows. The impeller can be rotated to suction fuel from the outside of the casing into the pump passage, pressurize the suctioned fuel, and discharge the pressurized fuel out of the casing (see JP-A-H9-512323, JP-A-2000-329085 corresponding to U.S. Pat. No. 6,336,788, and JP-A-2003-502580 corresponding to U.S. Pat. No. 6,474,937).

The fuel pump disclosed in each of JP-A-H9-512323 (corresponding to U.S. Pat. No. 5,785,490), JP-A-2000-329085, and JP-A-2003-502580 includes an impeller and a pump passage, which has a pressurizing passage and a discharge passage. The discharge passage extends from the downstream end of the pressurizing passage. The fuel pressurized by the rotation of the impeller flows through the pressurizing passage. The fuel pressurized in the pressurizing passage is discharged through the discharge passage in a direction away from the impeller toward a motor of the fuel pump.

In the fuel pump disclosed in each of JP-A-H9-512323 and JP-A-2000-329085, a passage width of the downstream end of the pressurizing passage becomes narrower toward the downstream side. A passage width of the discharge passage, which extends from the downstream end of the pressurizing passage, becomes wider toward the outlet of the discharge passage. The outlet is nearly equal or greater than the pressurizing passage in width. The radially inner wall of the discharge passage inclines inward from the inlet of the discharge passage to the outlet of the discharge passage.

In the fuel pump disclosed in JP-A-2003-502580, the discharge passage is narrower than the pressurizing passage. The inlet of this discharge passage opens at the bottom of the pressurizing passage.

Because the pressurizing passage extends along the circumferential array of vane grooves, centrifugal force acts on the fuel flowing through the pressurizing passage and the discharge passage. In the fuel pump disclosed in each of JP-A-H9-512323 and JP-A-2000-329085, a passage width of the downstream end of the pressurizing passage becomes narrower toward the downstream side, and the outlet of the discharge passage is nearly equal to or greater than the pressurizing passage in width. Because centrifugal force acts on the fuel flowing through the discharge passage, the fuel is out of contact with the radially inner wall of the discharge passage, so that a stagnant flow is prone to be made in the fuel passage.

If a stagnant flow is made near the radially inner wall of the discharge passage, a vortex is made in the flow. The fuel flowing into the discharge passage is directed to the radially outer wall of the discharge passage by the centrifugal force of the above made vortex. As a result, the fuel flowing near the radially outer wall is hindered from flowing toward the outlet of the discharge passage. Thus, even in a case, where the outlet is is made substantially equal to or greater than the pressurizing passage in width, the above hindering may decrease a sectional area of an effective part of a passage, though which the fuel to be discharged out of the casing member via the outlet flows disadvantageously. The above sectional area of the effective part is alternatively defined as an effective sectional area, in which the fuel effectively flows.

In the fuel pump disclosed in JP-A-2003-502580, the discharge passage, which is narrower than the pressurizing passage, extends from the bottom of the pressurizing passage. The sharp decrease in width at the junction of the two passages increases the energy loss in the fuel pump disadvantageously.

SUMMARY OF THE INVENTION

The present invention is made in view of the above disadvantages. Thus, it is an objective of the present invention to address at least one of the above disadvantages.

To achieve the objective of the present invention, there is provided a fuel pump, which includes an impeller and a casing member. The impeller defines a plurality of vane grooves arranged in a circumferential direction, and the impeller has a substantially disk shape. The impeller is rotatable. The casing member receives the impeller, and the casing member defines therein a pump passage that is configured to have an arcuate shape along the plurality of vane grooves of the impeller such that fuel suctioned by rotation of the impeller is pressurized in the pump passage. The pump passage includes a pressurizing passage and a discharge passage. The pressurizing passage allows the fuel pressurized by the rotation of the impeller to flow therethrough, and the pressurizing passage has a radially outer wall and a bottom. The discharge passage is provided downstream of the pressurizing passage in a flow direction of the fuel, and the discharge passage allows the pressurized fuel in the pressurizing passage to be discharged in a direction away from the impeller. The discharge passage has a width narrower than a width of the pressurizing passage, and the discharge passage is positioned toward the radially outer wall of the pressurizing passage. The discharge passage has an inlet. The pressurizing passage includes a throttle part that extends from (a) a starting point, at which the bottom of the pressurizing passage starts inclined toward the inlet of the discharge passage, to (b) the inlet of the discharge passage. The throttle part has a first width at the starting point, which first width corresponds to the width of the pressurizing passage, and a second width at the inlet of the discharge passage, which second width corresponds to the width of the discharge passage.

To achieve the objective of the present invention, there is also provided a fuel pump for pumping fuel, which pump includes an impeller and a pump casing. The impeller defines a plurality of vane grooves arranged in a circumferential direction, and the impeller has a substantially disk shape. The impeller is rotatable about a rotation axis. The pump casing has a recess on a first axial end of the pump casing along the rotation axis, and the pump casing receives the impeller in the recess. The pump casing has a pressurizing passage, a throttle part, and a discharge passage. The pressurizing passage is defined on a bottom of the recess to extend in the circumferential direction along the plurality of vane grooves, and the pressurizing passage is in fluid communication with the plurality of vane grooves. The throttle part is defined on the bottom of the recess downstream of the pressurizing passage in a flow direction of fuel to be in fluid communication with the pressurizing passage. The discharge passage is defined in the pump casing downstream of the throttle part in the flow direction of fuel to be in fluid communication with the throttle part, and the discharge passage has an outlet that opens at a second axial end of the pump casing along the rotation axis. The second axial end is opposite to the first axial end. The throttle part is angled toward the second axial end of the pump casing relative to the pressurizing passage. The throttle part has a first width at an upstream end of the throttle part, and the first width corresponds to a width of the pressurizing passage. The throttle part has a second width at a downstream end of the throttle part, and the second width corresponds to a width of the discharge passage and is smaller than the first width.

BRIEF DESCRIPTION OF THE DRAWINGS

The invention, together with additional objectives, features and advantages thereof will be best understood from the following description, the appended claims and the accompanying drawings in which:

DETAILED DESCRIPTION OF PREFERRED EMBODIMENTS

Figure 1:
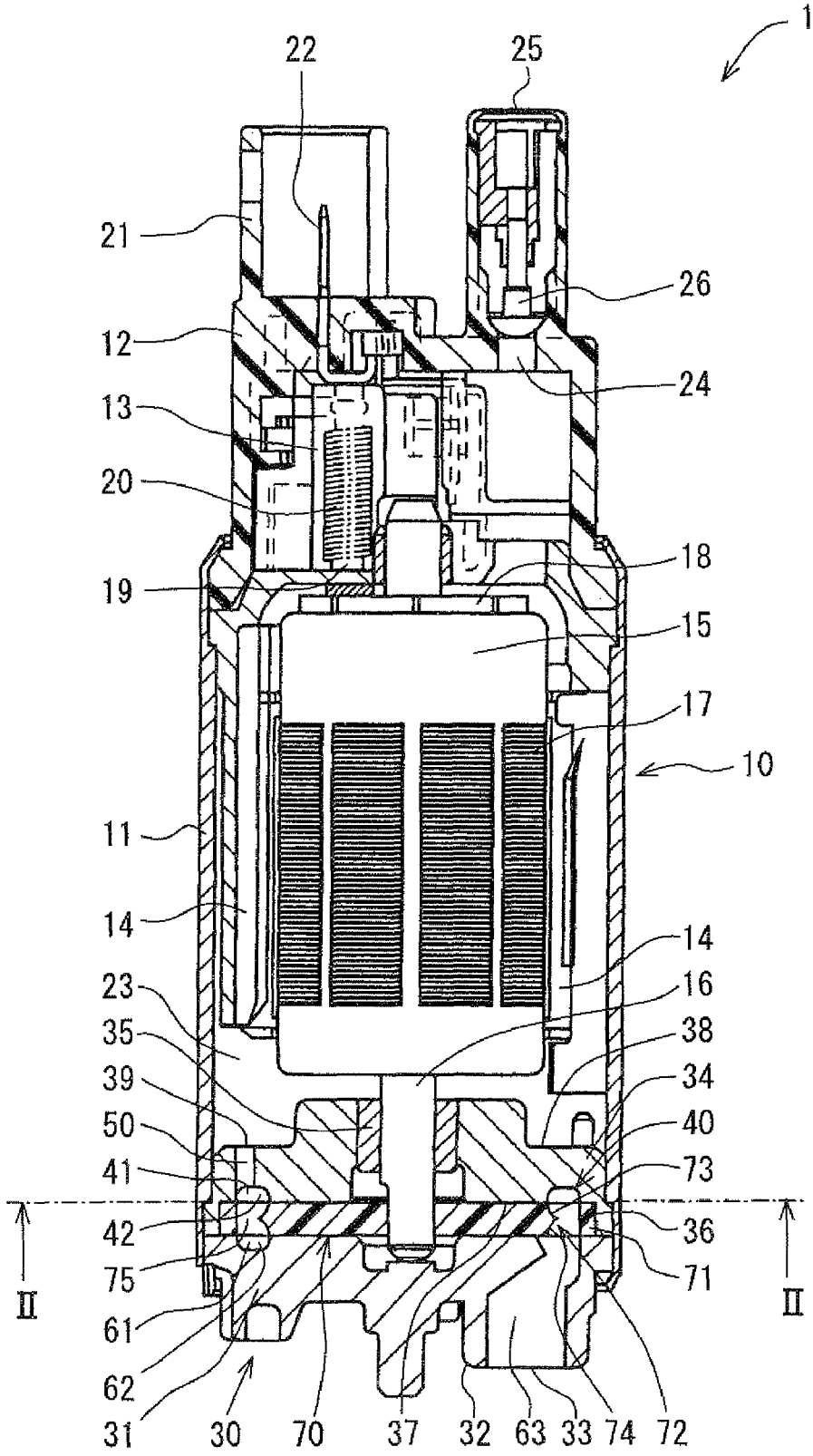
FIG. 1 is a sectional view of a fuel pump according to a first embodiment of the present invention.

Embodiments of the present invention will be described below with reference to the accompanying drawings, in which identical and equivalent parts are assigned the same reference numerals.

First Embodiment

FIG. 1 shows a fuel pump 1 according to a first embodiment of the present invention. The fuel pump 1 may be an in-tank pump for use in the fuel tank of a vehicle or the like. The fuel pump 1 suctions fuel from the fuel tank of a vehicle to pressurize the suctioned fuel, and discharges the pressurized fuel. The discharged fuel is supplied to the engine as the fuel consuming apparatus of the vehicle. The fuel pump 1 includes a motor unit 10 and a pump unit 30. The motor unit 10 includes an armature 15, which rotates to drive the pump unit 30 so as to pressurize the suctioned fuel.

The motor unit 10 is a DC motor with a brush and further includes a cylindrical housing 11 and permanent magnets 14, which are arranged annularly in the housing 11 and surround the armature 15. A cover 12 is crimped or otherwise fixed to the end of the housing 11 that is opposite to the pump unit 30.

The armature 15 is supported rotatably inside the permanent magnets 14 and includes a core (not shown) and a coil 17, each of which is formed on the core. A commutator 18 in the form of a disc is fitted on the top of the armature 15. A terminal 22 is embedded in a connector 21. A power source (not shown) supplies the coil 17 with electric power through the terminal 22, a brush 19, and the commutator 18.

The cover 12 has a space 13 formed in it, in which the brush 19 is movable axially. The brush 19 is biased by a spring 20 toward the armature 15 and is brought into slidable contact with the commutator 18. The power supplied through the brush 19 and commutator 18 rotates the armature 15. The armature 15 has a shaft 16, which rotates an impeller 70.

The pump unit 30 is a Wesco pump and includes a pump cover 31, a pump casing 34, and the impeller 70. The pump casing 34 is held between the pump cover 31 and the housing 11. The pump casing 34 supports a bearing 35 in the inner periphery of the pump casing 34. The impeller 70 is supported rotatably between the pump cover 31 and the pump casing 34. The pump cover 31 and the pump casing 34 correspond to a casing member.

The impeller 70 is made of a resin substantially in the form of a disk or has a substantially disk shape, and is fixed to the shaft 16 of the armature 15. The impeller 70 includes an outer ring 71, which is coaxial with the shaft 16 of the armature 15. The outer ring 71 continuously extends in a circumferential direction at an radially outer edge of the impeller 70. The impeller 70 has a circumferential array of vane grooves 72 formed on a radially inner side of the ring 71. In other words, the multiple vane grooves 72 of the circumferential array are defined in the impeller 70 and are arranged in the circumferential direction.

The vane grooves 72 are formed on both axial sides of the impeller 70 along the rotation axis. Specifically, the vane grooves 72 include inner grooves 73 and outer grooves 74. The inner grooves 73 are formed on the side of the impeller 70 that is adjacent to the motor unit 10. The outer grooves 74 are formed on the other side of the impeller 70 opposite to the inner grooves 73. The impeller 70 also has communicating passages 75, each of which connects one of the inner grooves 73 and a corresponding one of the outer grooves 74.

The pump cover 31 and the casing 34 are formed by aluminum die casting or cold forging, and each of the pump cover 31 and the casing 34 substantially has the form of a disk. The pump casing 34 has a recess 36 formed on a side adjacent to or toward the pump cover 31. The impeller 70 is positioned in the recess 36. The impeller 70 is provided between the pump cover 31 and the casing 34 along the rotation axis of the impeller 70 or along the longitudinal axis of the fuel pump 1 so as to be received in the space defined by the pump cover 31 and the casing 34.

The pump cover 31 has a suction port 33 formed on its side 32 away from the impeller 70. The pump casing 34 has a discharge port 39 formed on an axial end face 38 of the pump casing 34 away from the impeller 70 (away from the recess 36) along the longitudinal axis of the fuel pump 1. Each of the pump cover 31 and casing 34 has a pump passage 40, which connects the ports 33 and 39.

The pump passage 40 of the pump cover 31 and casing 34 includes an outer passage 61 and an inner passage 41. The outer passage 61 is formed on the side of the pump cover 31 that is adjacent to the impeller 70. The inner passage 41 is formed at the bottom 37 of the recess 36 of the pump casing 34. The passages 61 and 41 communicate with the ports 33 and 39 respectively. In the above, the bottom 37 of the recess 36 is a surface that faces in the longitudinal direction toward the impeller 70, for example.

The outer passage 61 includes an arcuate pressurizing passage 62 (second pressurizing passage) in the form of a groove and a suction passage 63. The pressurizing passage 62 extends along the circumferential array of vane grooves 72 of the impeller 70. The suction passage 63 connects the upstream end of the pressurizing passage 62 and the suction port 33. In the above, the upstream end is determined relative to the flow direction of the fuel.

Figure 2:
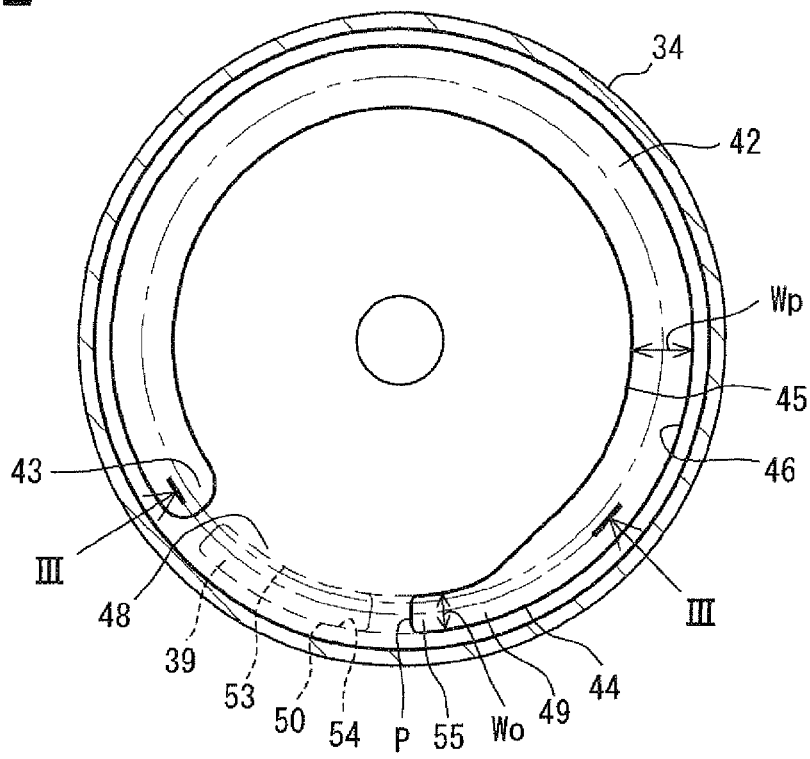
FIG. 2 is a sectional view of the fuel pump taken along line II-II in FIG. 1.

With reference to FIG. 2, the inner passage 41 includes an arcuate pressurizing passage 42 (first pressurizing passage) in the form of a groove and a discharge passage 50. The pressurizing passage 42 extends along the circumferential array of vane grooves 72 of the impeller 70 such that the pressurizing passage 42 is in fluid communication with the vane grooves 72. The discharge passage 50 connects the downstream end 44 of the pressurizing passage 42 and the discharge port 39. In the above, the downstream end is determined relative to the flow direction of the fuel.

As shown in FIG. 1, the motor unit 10 rotates the impeller 70 so as to suction fuel from the fuel tank through the suction port 33 into the suction passage 63, from which the fuel flows into the pressurizing passages 42 and 62. The rotation of the impeller 70 exerts kinetic energy on the fuel in the pressurizing passages 42 and 62 so as to pressurize it. The pressurized fuel is discharged from the pressurizing passages 42 and 62 through the discharge port 39 of the discharge passage 50 into the fuel chamber 23 of the motor unit 10. The fuel in the fuel chamber 23 flows through the space around the armature 15 and the discharge passage 24 of the cover 12 and is discharged through the fuel outlet 25 of the cover 12 to the outside of the fuel pump 1. The fuel outlet 25 receives therein a check valve 26, which prevents the backflow of the fuel that has been once discharged through the outlet 25.

Figure 3:
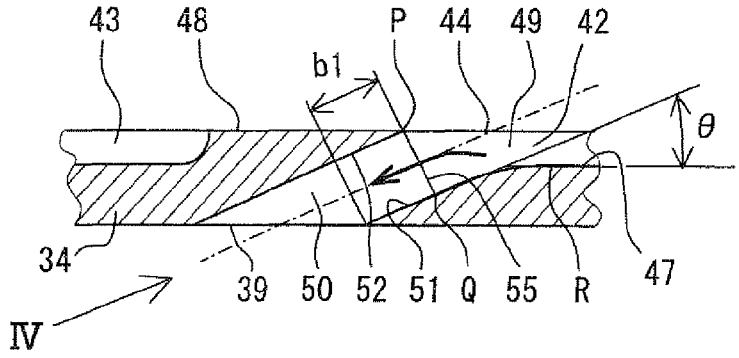
FIG. 3 is a sectional view of a pump casing taken along line III-III in FIG. 2.

The inner passage 41 will be described below in detail. As shown in FIG. 2, the pressurizing passage 42 has a substantially constant width Wp except for the downstream end 44. As shown in FIG. 3, the pressurizing passage 42 has a substantially constant depth except for the downstream end 44. Except for the downstream end 44, the bottom 47 of the pressurizing passage 42 extends substantially parallel to both axial end faces of the impeller 70, which end faces face in the rotation axial direction of the impeller 70.

The downstream end 44 of the pressurizing passage 42 communicates with the discharge passage 50. The pressurizing passage 42 extends along the bottom 37 of the recess 36. With reference to FIGS. 1 and 3, the discharge passage 50 inclines toward the axial end face 38 of the pump casing 34, on which end face the discharge port 39 is provided. As shown in FIG. 2, the discharge passage 50 has a width Wo narrower than a width Wp of the pressurizing passage 42. With reference to FIG. 2, a center line, which is shown by a chain line, of the discharge passage 50 is radially positioned between (a) a center line, which is shown by another chain line, of the pressurizing passage 42 and (b) a radially outer wall 46 of the pressurizing passage 42. In the above, each of the center line of the discharge passage 50 and the center line of the pressurizing passage 42 includes a center of the width of the respective passage. In the above, the width is measured in a radial direction of the impeller. As a result, the discharge passage 50 is apart from a rotation axis of the impeller 70 in the radial direction of the impeller 70 by a first dimension. The pressurizing passage 42 is apart from the rotation axis in the radial direction by a second dimension that is smaller than the first dimension. In other words, a radially inner wall 53 of the discharge passage 50 is apart from the rotation axis of the impeller 70 in the radial direction by the first dimension, and a radially inner wall 45 of the pressurizing passage 42 is apart from the rotation axis in the radial direction by the second dimension that is smaller than the first dimension.

As shown in FIGS. 2 and 3, the pump casing 34 includes a sealing part 48 circumferentially formed between the upstream end 43 and the downstream end 44 of the pressurizing passage 42. Avery small axial gap is formed along the rotation axis of the impeller 70 or in a thickness direction of the impeller 70 between the sealing part 48 and the adjacent face of the impeller 70. The sealing part 48 limits the fuel pressurized in the pressurizing passage 42 from leaking out of the downstream end 44 into the upstream end 43 while the pressurized fuel is discharged through the discharge passage 50.

As shown in FIG. 3, the discharge passage 50 has a bottom-side wall 51 and an impeller-side wall 52 opposite to each other. The bottom-side wall 51 is connected to the bottom 47 of the pressurizing passage 42. As shown in FIG. 3, an end of the impeller-side wall 52 that is adjacent to the pressurizing passage 42 is connected to an end of the sealing part 48 that is adjacent to the downstream end 44 of the pressurizing passage 42. In other words, the impeller-side wall 52 is the closest to the impeller 70 at the above adjacent end of the impeller-side wall 52.

The bottom-side wall 51 and the impeller-side wall 52 of the discharge passage 50 are parallel to each other between an inlet 55 and an outlet 39 of the discharge passage 50. The inlet 55 of the discharge passage 50 is defined by points P and Q. The impeller-side wall 52 and the sealing part 48 meet at the point P. The bottom-side wall 51 and a virtual line extending through the point P perpendicularly to the impeller-side wall 52 meet at the point Q. The outlet 39 corresponds to the above-described discharge port 39.

As shown in FIG. 3, the bottom 47 of the pressurizing passage 42 becomes deeper from a starting point R near the downstream end 44 of the pressurizing passage 42 toward the inlet 55 of the discharge passage 50. The bottom 47 is connected to the inlet 55 at the point Q. In the above, when the bottom 47 of the pressurizing passage 42 becomes deeper, the bottom 47 is more displaced from the impeller 70 in a direction away from the impeller 70 along the longitudinal axis of the fuel pump 1, for example. The angle θ measured between (a) the bottom-side wall 51 of the discharge passage 50 and (b) the bottom 47 of the pressurizing passage 42 is set equal to or less than 40 degrees.

As shown in FIG. 3, the bottom-side wall 51 and the impeller-side wall 52 of the discharge passage 50 are configured to have dimensions in the longitudinal axis of the discharge passage 50, which dimensions are long enough such that the bottom-side wall 51 and the impeller-side wall 52 partially face with each other. In the present embodiment, the bottom-side wall 51 and the impeller-side wall 52 have facing portions of a distance b1, which facing portions face with each other.

As shown in FIG. 2, the radially inner wall 45 of the pressurizing passage 42 is connected to the radially inner wall 53 of the discharge passage 50. Likewise, a radially outer wall 46 of the pressurizing passage 42 is connected to a radially outer wall 54 of the discharge passage 50. In the above, the radially inner wall 45 is provided inward of the radially outer wall 46 along a radial axis of the pump casing 34 or the fuel pump 1. As shown in FIG. 2 and described above, the width Wo of the discharge passage 50 is narrower than the width Wp of the pressurizing passage 42, and the center line of the discharge passage 50 is radially positioned between (a) the center line of the pressurizing passage 42 and (b) the radially outer wall 46 of the pressurizing passage 42. In the above, the center line of the pressurizing passage 42 is radially positioned in a middle of the radially inner wall 45 and the radially outer wall 46, for example.

The downstream end 44 of the pressurizing passage 42 has a throttle part 49. The throttle part 49 connects the pressurizing passage 42 with the discharge passage 50, which is narrower than the pressurizing passage 42. With reference to FIGS. 2 and 3, the throttle part 49 is formed between the starting point R and the point Q. In other words, the throttle part 49 extends from the pressurizing passage 42 at the starting point R to the inlet 55 of the discharge passage 50 at the point Q.

As shown in FIG. 2, the throttle part 49 is formed such that the radially inner wall 45 of the pressurizing passage 42 becomes closer to the radially outer wall 46 of the pressurizing passage 42 as a function of the position in the throttle part 49 from the starting point R toward the inlet 55 of the discharge passage 50. On the downstream side of the inlet 55, the radially inner wall 53 and radially outer wall 54 of the discharge passage 50 are substantially parallel to each other. In other words, the radially inner wall 53 and the radially outer wall 54 extend to the outlet 39 of the discharge passage 50, with the passage width Wo measured between the walls 53, 54 maintained.

With reference to FIGS. 2 and 3, the inclination angle of the bottom 47 of the throttle part 49 and the inclination angle of the radially inner wall 45 of the throttle part 49 are designed such that the throttle part 49 between the starting point R and the inlet 55 of the discharge passage 50 is as similar as possible in sectional area to the pressurizing passage 42 upstream of the starting point R. In other words, the throttle part 49 has an area of the cross section, which is taken perpendicular to a flow axis of the fuel through the throttle part 49, is generally constant over the length of the throttle part 49, and is generally identical with an area of the cross section of the pressurizing passage 42 upstream of the starting point R, for example.

Figure 4:
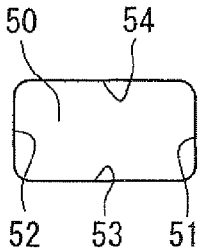
FIG. 4 is a diagram of a discharge passage viewed in a direction IV in FIG. 3.

FIG. 4 shows the discharge passage 50 as viewed in a direction IV shown in FIG. 3. As shown in FIG. 4, the radially inner wall 53 and radially outer wall 54 of the discharge passage 50 are substantially perpendicular to the bottom-side wall 51 and the impeller-side wall 52 of the discharge passage 50.

It will be described below in detail how fuel flows through the pressurizing passage 42 and the discharge passage 50 when the impeller 70 is rotated.

With reference to FIG. 1, the motor unit 10 rotates the impeller 70 in the direction in which the vane grooves 72 turn from the suction port 33 to the discharge port 39. The rotation develops a suction force in the pump passage 40 to suction fuel thereinto through the suction port 33. The suctioned fuel flows into the pressurizing passage 62 of the outer passage 61 through the suction passage 63. Also, the suctioned fuel flows into the pressurizing passage 42 of the inner passage 41 through the suction passage 63, the pressurizing passage 62, the outer grooves 74, the communicating passages 75, and the inner grooves 73.

The fuel in the pressurizing passage 42 moves from the radially outer side of the inner grooves 73 and flows along the radially outer wall 46, the bottom 47, and the radially inner wall 45 of the pressurizing passage 42 in this order. Then, the fuel turns or moves toward the radially inner side of the inner grooves 73, and flows toward the discharge port 39. As above, the fuel in the pressurizing passage 42 forms a helical or swirl like flow that flows in a circumferential direction, for example.

Similar to the fuel in the above pressurizing passage 42, the fuel in the pressurizing passage 62 moves from the radially outer side of the outer grooves 74 and flows along the radially outer side, the bottom, and the inner side of the pressurizing passage 62 in this order. Then, the fuel turns or moves toward the inner sides of the outer grooves 74, and flows toward the discharge port 39.

With reference to FIG. 3, at the throttle part 49 of the pressurizing passage 42, the swirl flow in the pressurizing passage 42 changes into a flow toward the discharge passage 50. The fuel in the pressurizing passage 62 moves through the communicating passages 75 to the pressurizing passage 42 and flows toward the discharge passage 50. The fuel flowing near the bottom 47 of the pressurizing passage 42 flows along the bottom 47 toward the inlet 55 of the discharge passage 50.

Because the pressurizing passage and the discharge passage are arcuate or have C shapes, the centrifugal action of the fuel flowing through these passages causes the fuel to flow faster near their outer sides than near their inner sides.

At the throttle part 49 of the pressurizing passage 42, the radially inner wall 45 of the pressurizing passage 42 is configured to be displaced toward the radially outer wall 46 of the pressurizing passage 42. In general, a stagnant fuel flow is prone to be made near the radially inner wall 53. In the present embodiment, because of the above described configuration, the fuel flow near the radially outer wall 54 of the discharge passage 50 drags the fuel near the radially inner wall 53 of the discharge passage 50. Thus, the fuel around the radially inner wall 53, which fuel otherwise may be stagnant, is also caused to flow toward the outlet 39 of the discharge passage 50 effectively.

The fuel flow created near the radially inner wall 53 of the discharge passage 50 causes fuel to flow along the radially inner wall 53, so that the fuel stagnation is restrained. This makes it possible to reduce the energy loss caused in the fuel pump by the fuel stagnation near the radially inner wall 53.

The radially inner wall 53 and radially outer wall 54 of the discharge passage 50 are substantially parallel between the inlet 55 and outlet (discharge port) 39 of the discharge passage 50. This makes it possible to stabilize the fuel flow through the discharge passage 50.

In the present embodiment, because the throttle part 49 is provided upstream of is the inlet 55 of the discharge passage 50, it is possible to limit the fuel stagnation in the discharge passage 50. The above stagnation limitation in the discharge passage 50 develops negative pressure (vacuum pressure) near the radially inner wall 53 of the passage 50. The negative pressure attracts fuel toward the radially inner wall 53. This makes it possible to limit the decrease of the effective sectional area of the discharge passage 50, thereby reducing the factors for impeding the fuel flow toward the outlet 39 of the passage 50. As a result, the entirety of the discharge passage 50 is used more effectively.

As above, the throttle part 49 extends between (a) the starting point R, where the bottom 47 of the pressurizing passage 42 starts to incline toward the inlet 55 of the discharge passage 50, and (b) the point Q at the inlet 55. As a result, energy loss is reduced, and the decrease of the effective sectional area of the discharge passage 50 is successfully limited from decreasing, without sacrificing the pressurizing performance of the fuel pump 1.

At the throttle part 49 in the present embodiment, the angle θ measured between (a) the bottom 47 of the pressurizing passage 42 that is upstream of the starting point R and (b) the bottom-side wall 51 of the discharge passage 50 is equal to or less than 40 degrees. Accordingly, the fuel flowing near the bottom 47 is capable of flowing into the discharge passage 50 without being out of contact with the bottom 47.

The discharge passage 50 is defined by the four walls 51-54. Specifically, the radially inner wall 53 and the radially outer wall 54 are substantially orthogonal to the bottom-side wall 51 and the impeller-side wall 52. Accordingly, the four walls 51-54 are capable of stabilizing the fuel flow through the discharge passage 50.

The bottom-side wall 51 and the impeller-side wall 52 of the discharge passage 50 are configured to extend substantially parallel to each other and have the facing portions of the distance b1, which portions face each other. Accordingly, negative pressure attracts fuel to the vicinities of the bottom-side wall 51 and the impeller-side wall 52 as well. Therefore, the fuel stagnation is limited at the radial walls (the radially inner wall 53 and the radially outer wall 54) of the discharge passage 50. Furthermore the fuel stagnation is limited at the orthogonal walls (the bottom-side wall 51 and the impeller-side wall 52) of the discharge passage 50, which walls are orthogonal to the radial walls.

Figure 5:
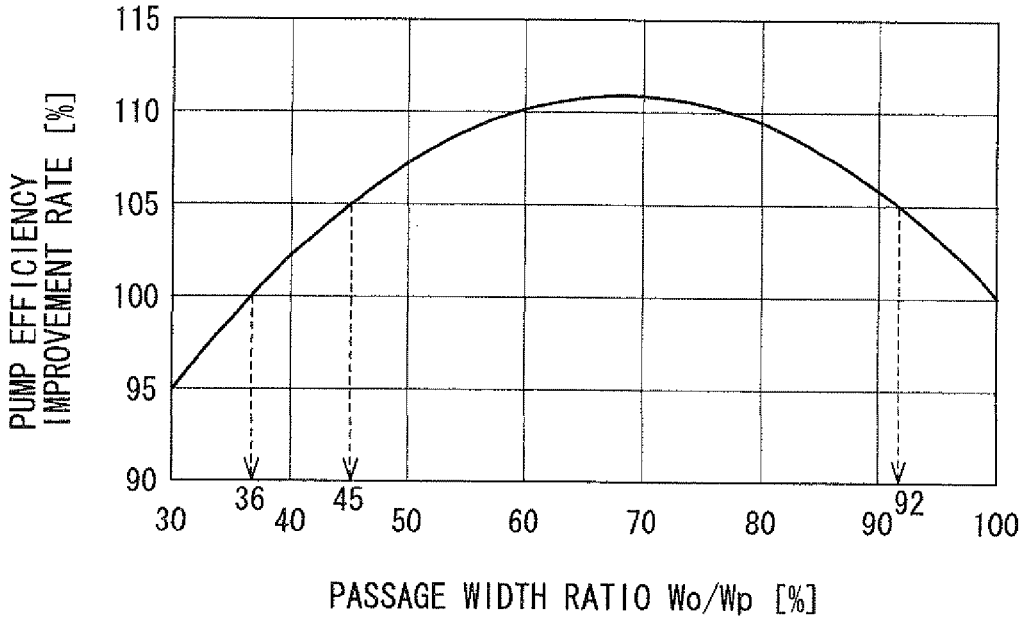
FIG. 5 is a characteristic curve representing a pump efficiency improvement rate as a function of a ratio of the passage width Wo to the passage width Wp.

The relationship between the width Wp of the pressurizing passage 42 and the width Wo of the discharge passage 50 shown in FIG. 2 will be described below in detail with reference to the characteristic curve of FIG. 5. The characteristic curve of FIG. 5 represents the pump efficiency improvement rate that varies with the ratio of the width Wo to the width Wp on the basis of a reference pump efficiency. The reference pump efficiency is the pump efficiency of the pump unit 30 that is obtained in a case, where the widths Wo and Wp are equal to each other. The characteristic curve shown in FIG. 5 is found according to a simulation. In a case, where the discharge rate, discharge pressure, torque, and speed of rotation of the pump unit 30 are Q, P, T, and N, respectively, the pump efficiency is $(Q\times P)/(T\times N)$. The pump efficiency varies with the discharge rate Q, discharge pressure P, torque T, and speed of rotation N of the pump unit 30, which vary with the ratio of the width Wo to the width Wp.

As shown in FIG. 5, in a case, where the width ratio Wo/Wp is not lower than 36% but lower than 100%, the pump efficiency for the above width ratio is higher than the reference pump efficiency. In another case, where the width ratio Wo/Wp is lower than 36%, the width Wo of the discharge passage 50 is so narrow as to lower the pump efficiency.

For example, the width ratio Wo/Wp may be in a range of 45-92% such that, as shown in FIG. 5, the pump efficiency improvement rate is 105% or higher. According to the inventor's experience, a difference of 3-4% arises between (a) the calculated pump efficiency based on the simulation and (b) the actual pump efficiency measured on a real fuel pump. In a case, where the pump efficiency improvement rate is 105% or higher, the width ratio Wo/Wp is large enough to cover or compensate the above difference.

Figure 6:
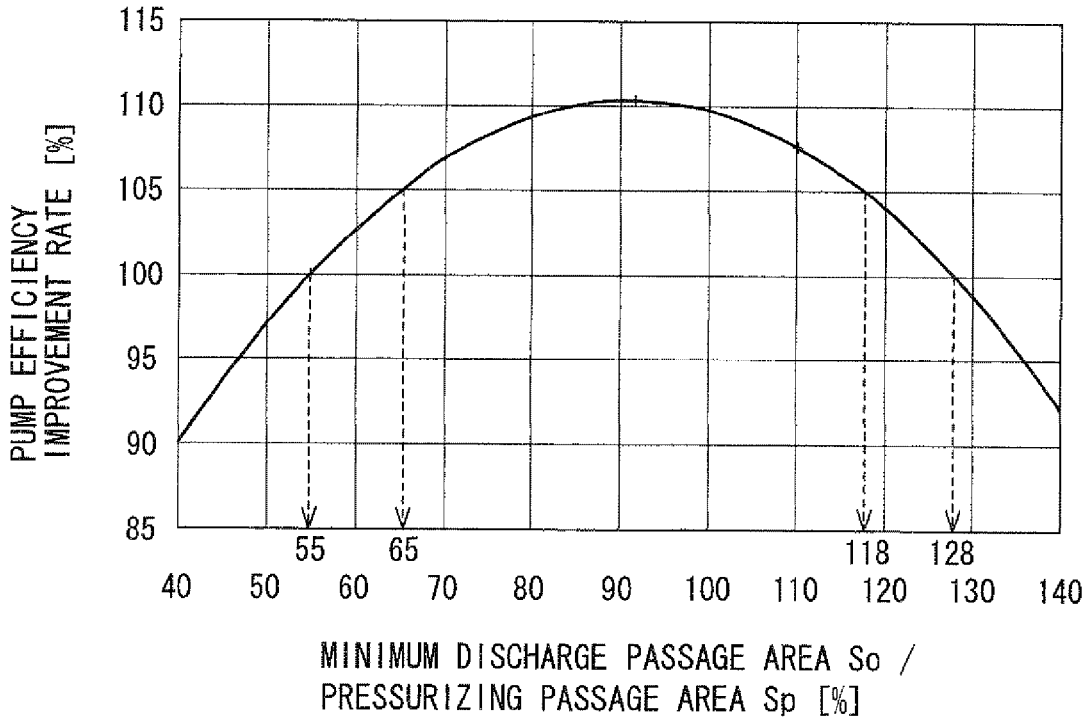
FIG. 6 is a characteristic curve representing a pump efficiency improvement rate as a function of a ratio of (a) a minimum sectional area So of the discharge passage formed in the pump casing of the fuel pump to (b) a total sectional area Sp of the is pressurizing passages formed in the pump cover and pump casing of the pump.

With reference to the characteristic curve shown in FIG. 6, a detailed description will be provided below of the relationship between (a) a total sectional area Sp of the pressurizing passages 42 and 62 defined in the pump cover 31 and pump casing 34 and (b) a minimum sectional area So of the discharge passage 50 shown in FIGS. 1 and 4. FIG. 6 shows the pump efficiency improvement rate that varies with or changes as a function of the ratio of (a) the minimum sectional area So to (b) the total sectional area Sp on the basis of a reference pump efficiency. The reference pump efficiency is the pump efficiency of the pump unit 30 that is obtained in a case, where the area ratio So/Sp is a specified ratio. In the above, the minimum sectional area So indicates a smallest cross sectional area measured over the length of the discharge passage 50, for example.

The specified ratio of the minimum sectional area So to the total sectional area Sp is about 130%, which corresponds to the ratio of the minimum sectional area of a discharge passage to the total sectional area of pressurizing passages formed in a pump cover and a pump casing according to a certain fuel pump that has been used by the inventor.

In general, the minimum sectional area of the discharge passage of a conventional fuel pump is larger than the total sectional area of the pressurizing passages formed in the pump cover and pump casing of the pump. In many conventional fuel pumps, the discharge passage has a sectional area larger by about 30% than the total sectional area of the pressurizing passages. In the present embodiment, the reference ratio of the minimum sectional area So to the total sectional area Sp is set about 130% which correspond to the ratio of the minimum sectional area of the discharge passage to the total sectional area of the pressurizing passages of the general fuel pump.

As shown in FIG. 6, in a case, where the area ratio So/Sp is in a range of 55-128%, the pump efficiency for the above area ratio is higher than the reference pump efficiency. Therefore, the ratio So/Sp being lower than 55% means that fuel flows into the discharge passage 50 by an amount that is larger than the discharge capacity of the discharge passage 50. As a result, the pump efficiency is reduced. If the ratio So/Sp is higher than 128%, it is necessary to increase the distance between the walls of the discharge passage 50. As a result, fuel becomes less attracted to the walls of the discharge passage 50, thereby making fuel prone to stagnate. Accordingly, the pump efficiency is reduced.

For example, the area ratio So/Sp may be set in a range of 65-118% such that, as shown in FIG. 6, the pump efficiency improvement rate is estimated to be 105% or higher. The pump efficiency improvement rate is set 105% or higher again because the above rate is large enough to cover the possible difference of 3-4% made between the calculated pump efficiency based on the simulation and the actually measured pump efficiency, as stated with reference to FIG. 5.

Second Embodiment

Figure 7:
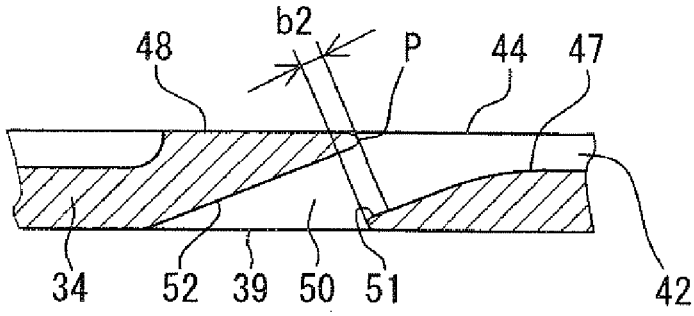
FIG. 7 is an enlarged sectional view of a part of a fuel pump according to a second embodiment of the present invention.

A fuel pump according to a second embodiment of the present invention will be described below. FIG. 7 is an enlarged sectional view of a part of the pump casing viewed in a direction similar to the direction III in FIG. 2. Descriptions will be provided below only of parts of the present embodiment that differ from the corresponding parts in the first embodiment.

As shown in FIG. 7, a connection point P between (a) the end of the sealing part 48 that is adjacent to the downstream end 44 of the pressurizing passage 42 and (b) the impeller-side wall 52 of the discharge passage 50 is not acute, but is made flat or round. Likewise, the outlet 39 formed adjacent to the end of the bottom-side wall 51 is made flat or round. In other words, the most end of the bottom-side wall 51 at the outlet 39 is flat or round.

The connection point P and the end of the bottom-side wall 51 are flat or round for manufacturing and assembling purposes. For example, in a comparison case, where the point P and the end of the bottom-side wall 51 are acute, the above acute parts are fragile and might break in the manufacturing process (in particular, at the demolding step) or in the assembly process. Therefore, in the above comparison case, the sealing part 48 including the connection point P, may be treated with alumite for higher abrasion or wear resistance against the impeller 70 and for the better lubrication.

If the acute parts are treated with alumite as above, the alumite layers of the treated parts may become thicker than the alumite layers of other parts, and thereby may hinder the rotation of the impeller 70. In the present embodiment, by making the connection point P flat or round, it is possible to uniformize the alumite layers, thereby making it possible to limit the rotation of the impeller 70 from being hindered.

Even though the connection point P and the outlet 39 are flat or round as stated above, the bottom-side wall 51 and the impeller-side wall 52 have facing portions of a distance b2, which facing portions face with each other, as is the case with the first embodiment.

Third Embodiment

Figure 8:
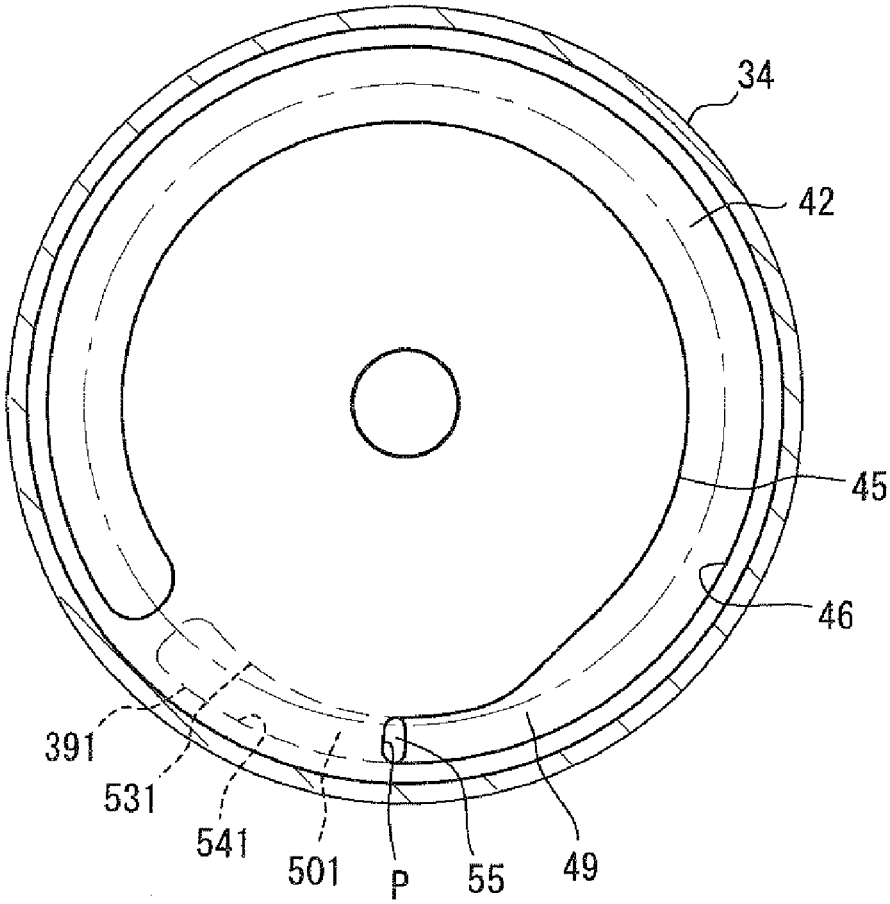
FIG. 8 is a sectional view of a fuel pump according to a third embodiment of the present invention.

A fuel pump according to a third embodiment of the present invention will be described below. FIG. 8 is a cross sectional view of the pump that is taken along lines corresponding to lines II in FIG. 1. Descriptions will be provided below only of parts of the present embodiment that differ from the corresponding parts in the first embodiment.

As shown in FIG. 8, the distance between the radially inner wall 531 and radially outer wall 541 of the discharge passage 501 is longer away from the inlet 55 toward the outlet 391. In other words, the radially inner wall 531 and the radially outer wall 541 become more spaced apart from each other toward a downstream side of the discharge passage 501. The distance between the walls 531 and 541 changes so gradually that the fuel flowing into the discharge passage 501 keeps in contact with the radially inner wall 531. This makes it possible to increase the discharge from the discharge passage 501 while fuel is limited from stagnating near the radially inner wall 531.

As is the case with the first embodiment, the connection point P and the outlet 391 may be acute in section as shown in FIG. 3. Alternatively, as is the case with the second embodiment, the connection point P and the outlet 391 may be flat or round in section as shown in FIG. 7.

Additional advantages and modifications will readily occur to those skilled in the art. The invention in its broader terms is therefore not limited to the specific details, representative apparatus, and illustrative examples shown and described.

What is claimed is:

1. A fuel pump comprising:

an impeller being in a substantially disk shape that defines a plurality of vane grooves in a circumferential direction, the impeller being driven and rotatable; and a casing member that receives the impeller, the casing member defining a pump passage in an arcuate shape along the vane grooves of the impeller such that fuel suctioned by rotation of the impeller is pressurized in the pump passage, wherein:

the pump passage includes:

a pressurizing passage that allows the fuel pressurized by the rotation of the impeller to flow therethrough; and a discharge passage that is provided in an end side of the pressurizing passage, the discharge passage allowing the pressurized fuel in the pressurizing passage to be discharged toward a bottom of the pressurizing passage, the discharge passage narrower than a width of the pressurizing passage, the discharge passage being positioned toward the radially outer wall of the pressurizing passage;

the pressurizing passage includes a throttle part in a range from a starting point, at which the bottom of the pressurizing passage starts inclined toward an inlet opening of the discharge passage, to an inlet opening of the discharge passage and throttles a passage width of the pressurizing passage to a passage width of the discharge passage; and a radially inner wall of the discharge passage and a radially outer wall of the discharge passage are in parallel with each other from the inlet opening of the discharge passage to an outlet opening of the discharge passage.

2. The fuel pump according to claim 1, wherein:

the discharge passage has:

an impeller-side sidewall that is substantially orthogonal to the radially inner wall of the discharge passage and the radially outer wall of the discharge passage; and a bottom-side sidewall that opposes the impeller-side sidewall and is connected with the bottom of the pressurizing passage; and the impeller-side sidewall and the bottom-side sidewall extend are in parallel with each other to have facing portions.

3. The fuel pump according to claim 1, wherein:

a ratio of the passage width of the inlet opening of the discharge passage to the passage width of the pressurizing passage is equal to or greater than 36% and is less than 100%.

4. The fuel pump according to claim 1, wherein:

a ratio of the passage width of the inlet opening of the discharge passage to the passage width of the pressurizing passage is in a range of 45% to 92%.

5. The fuel pump according to claim 1, wherein:

a ratio of a minimum passage sectional area of the discharge passage to a passage sectional area of the pressurizing passage is in a range of 55% to 128%.

6. The fuel pump according to claim 1, wherein:

a ratio of a minimum passage sectional area of the discharge passage to a passage sectional area of the pressurizing passage is in a range of 65% to 118%.

7. The fuel pump according to claim 1, wherein:

the discharge passage includes a bottom-side sidewall that is connected with the bottom of the pressurizing passage; and an angle between the bottom-side sidewall of the discharge passage and the bottom of the pressurizing passage is equal to or less than 40 degrees.

* * * * *